US005857828A

United States Patent [19]

Lee et al.

[11] Patent Number: 5,857,828

[45] **Date of Patent: *Jan. 12, 1999**

[54] PROCESS FOR AUTOMATICALLY CONTROLLING POWER EXCAVATORS

[75] Inventors: Si Cheon Lee, Changwon; Dong Jae Lee, Seoul, both of Rep. of Korea

[73] Assignee: Samsung Heavy Industries Co., Ltd., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 563,690

[22] Filed: Nov. 28, 1995

[30] Foreign Application Priority Data

Mar. 30, 1995 [KR] Rep. of Korea ..... 95-6980

[51] Int. Cl.[6] ..... B65G 65/04

[52] U.S. Cl. ..... 414/786; 414/699; 37/348

[58] Field of Search ..... 414/699, 786; 37/348

[56] References Cited

U.S. PATENT DOCUMENTS 4,288,196 9/1981 Sutton, II ..... 414/699

4,332,517 6/1982 Igarashi et al. ..... 414/699 X

FOREIGN PATENT DOCUMENTS

WO91/05113 4/1991 WIPO ..... 414/699

*Primary Examiner*—Donald W. Underwood

*Attorney, Agent, or Firm*—Kenyon & Kenyon

[57] ABSTRACT

A process for automatically controlling power excavators is disclosed. In the process, the motions of the working members in accordance with lever handling motions of an operator are stored in a controller and reproduced to approximately conduct the operation. The operational errors of the reproduced motions of the working members are corrected and compensated in accordance with newly inputted lever handling motions of the operator while approximately conducting the operation, thereby accomplishing the desired operation. The process optimally controls the excavators regardless of working conditions, thereby improving the operational precision of the excavators. The above process does not need to use any sensors.

3 Claims, 3 Drawing Sheets

PROCESS FOR AUTOMATICALLY CONTROLLING POWER EXCAVATORS

BACKGROUND OF THE INVENTION

1. Field of the Invention

The present invention relates in general to a process for automatically controlling construction equipment such as power excavators to conduct the desired operations.

2. Description of the prior Art

As well known to those skilled in the art, the working members such as a boom, an arm and a bucket of a typical power excavator are designed to be operated by pressurized oil outputted from a hydraulic pump driven by an engine. In typical power excavators, the pressurized oil of the pump is delivered to working member's actuators such as a boom cylinder, an arm cylinder and a bucket cylinder under the control of directional control valves. Therefore, starting, stopping and moving the working members or the actuators can be controlled by controlling the above directional control valves.

In addition, automatic power excavator have been proposed and used. The above automatic power excavator is provided with a control system for automatically controlling the operation of the actuators. The automatic control system typically includes a controller such as a microprocessor used for processing a preset control program. The above control system also includes a plurality of electrical control levers for applying the lever signals to the controller and for setting target values of the working members. The control system further includes a plurality of positional sensors for sensing output values, that is, the operational positions and angles of the working members, and for applying output value signals to the controller.

FIGS. 1 and 2 are block diagrams representing the construction and operation of the typical automatic control system for the automatic power excavator. The power excavator with the control system of the above drawings is assumed to have four working members, that is, a swing motor, a boom, an arm and a bucket.

As shown In FIG. 1, a plurality of signal sets "sa", "sb", "sc", "sd" and "se" flow in the control system when automatically controlling the operation of the four working members. Each signal set "sa", "sb", "sc", "sd", "se" has four signals used for controlling the four working members, respectively. The output value signals "se" outputted from the positional sensors mounted to the working members are fed back to the controller. Upon receiving the output value signals "se", the controller operates, i.e., processes the above signals "se" in accordance with the preset control program and applies the control signals "sa" to the directional control valves. At this time, the operator of the excavator presets the above control program by operating the control panel of the dashboard prior to starting the control system. In the operation of the power excavator, the operator starts or stops the working members or controls the moving directions of the working members by handling the electrical control levers. The control system will automatically be operated after starting in the manner as shown in FIG. 2. That is, the control system is almost automatically operated after starting under the control of the controller, while the operator simply handles the electrical control levers to perform as the above-mentioned extremely limited part, i.e., start or stop the working members or control the moving directions of the working members.

Typically, power excavators conduct various types of operations, such as land finishing and loading operations, under various working conditions. That is, power excavators may be operated on either rugged or smooth sites. Power excavators may be operated on sites having many or no obstacles. The weather of the sites may also vary. In addition, the power excavators may be operated on either firm or soft ground. However, the typical control programs used with the automatic control systems for the power excavators are programmed to be used in extremely normal working conditions. That is, the typical control programs are not programmed considering the different working conditions of the excavators due to technical difficulties. In this regard, when an automatic power excavator is operated in an abnormal working condition, for example, a rugged site having many obstacles, the power excavator will not achieve the desired operational precision. The power excavator in the above state will also be faced with the danger of a rollover accident.

As described above, the operator of the above automatic control system simply handles the electrical control levers to perform the extremely limited part, while the control system is almost automatically operated after starting under the control of the controller. Therefore, the automatic power excavator cannot be optimally operated in the abnormal working conditions, particularly, on a rugged site having many obstacles. In addition, the control algorithm of the control system for conducting a series of operations is extremely complicated. In order to conduct a series of operations under the control of the control system, the output values, or the output positions and angles of the working members, are sensed by positional sensors mounted to the working members. The sensors In turn apply output value signals to the controller. Upon receiving the output value signals, the controller operates,i.e., processes, the output value signals while comparing the output values with the preset target values, thereby precisely determining the output positions and angles of the working members. The controller in turn outputs control signals to the directional control valves, thereby allowing the working members to achieve the target positions and angles. The above control process overloads the controller and thereby extremely complicates the control algorithm. In this regard, the control process not only increases the cost of the control system, it also prevents the automatic power excavators from being optimally used in poor working conditions. The above control process also reduces the operational precision of the power excavators which operate in poor working conditions. The above problems are caused by the fact that the positional sensors mounted to the working members only sense the rudimentary output values of the working members. Furthermore, the controller only roughly controls the control system in accordance with the preset control program without any regard for the working conditions of the power excavator.

The automatic control system for the power excavators may be provided with many more sensors in order to optimize the control performance of the control system. However, the sensors are not only apt to experience difficulties in the poor working conditions, they also increase the cost of the control system.

In the above control process, the operator is required to handle the electrical control levers every time the operation of the power excavator changes to another operation. Therefore, the control process fails to preferably improve the operational efficiency of the excavator and is still inconvenient to the operator. Another problem of the above control process is resided in that the operator should handle the control levers when the operation of the power excavator needs to be slightly changed.

SUMMARY OF THE INVENTION

It is, therefore, an object of the present invention to provide a process for automatically controlling power excavators in which the above problems can be overcome and which optimally controls the operation of the excavators regardless of working conditions, thereby improving the operational precision of the excavators. The above process does not need to use any sensors and thereby reduces the cost caused by selecting and installing the sensors, removes the problem caused by troubled sensors, remarkably improves the operational efficiency of the excavators and is convenient to the operator.

In order to accomplish the above object, the present invention provides a process for automatically controlling a power excavator to conduct a desired operation comprising the steps of: storing the motions of a plurality of excavator's working members in accordance with lever handling motions of an operator and reproducing the stored motions of the working members to approximately conduct the desired operation; and correcting and compensating for operational errors of the reproduced motions of the working members in accordance with newly inputted lever handling motions of the operator while approximately conducting the operation, thereby accomplishing the desired operation.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
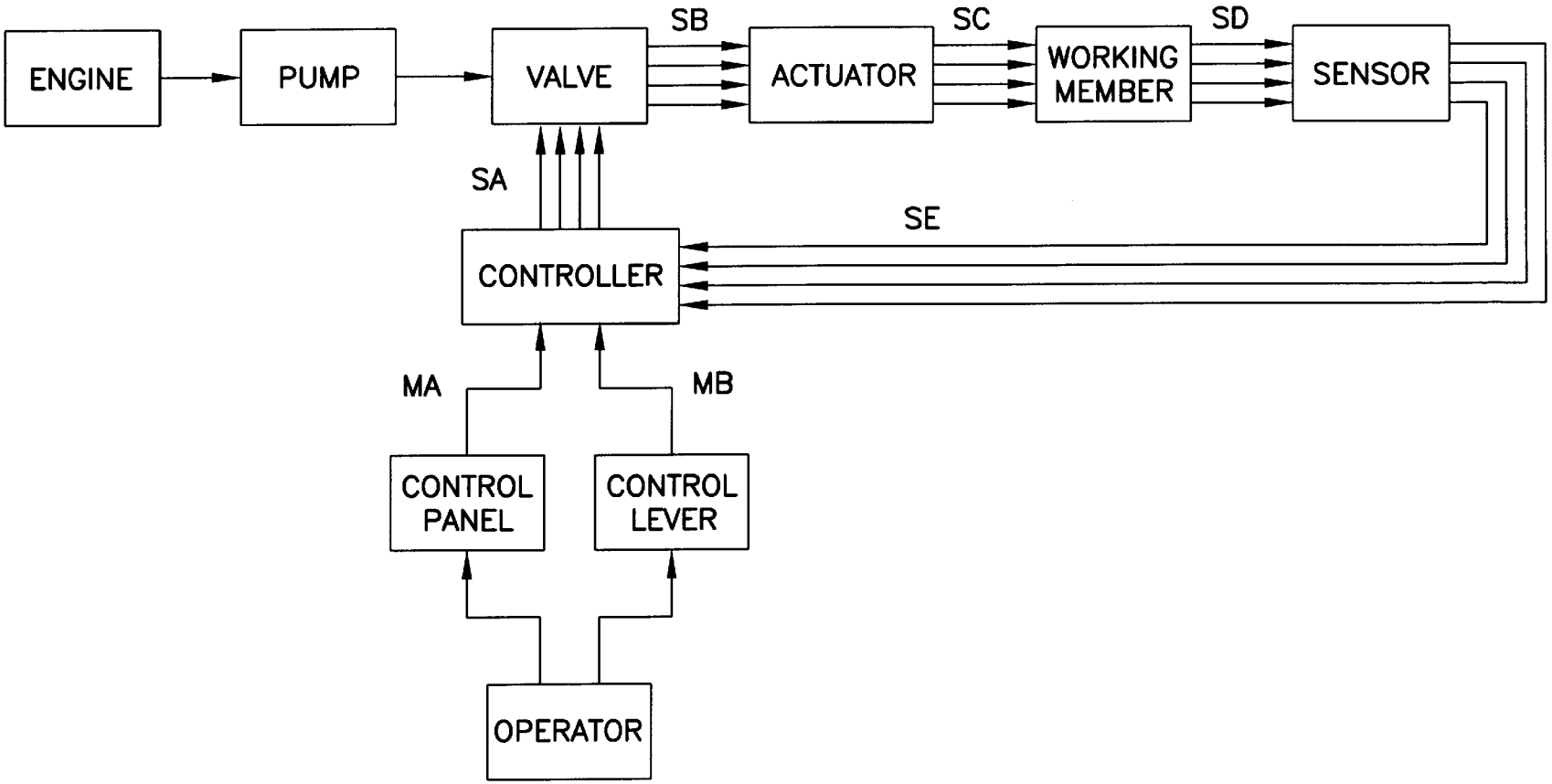
FIG. 1 PRIOR ART
FIGS. 1 and 2 are block diagrams showing the construction and signal flow of a typical automatic control system for power excavators.
Figure 2:
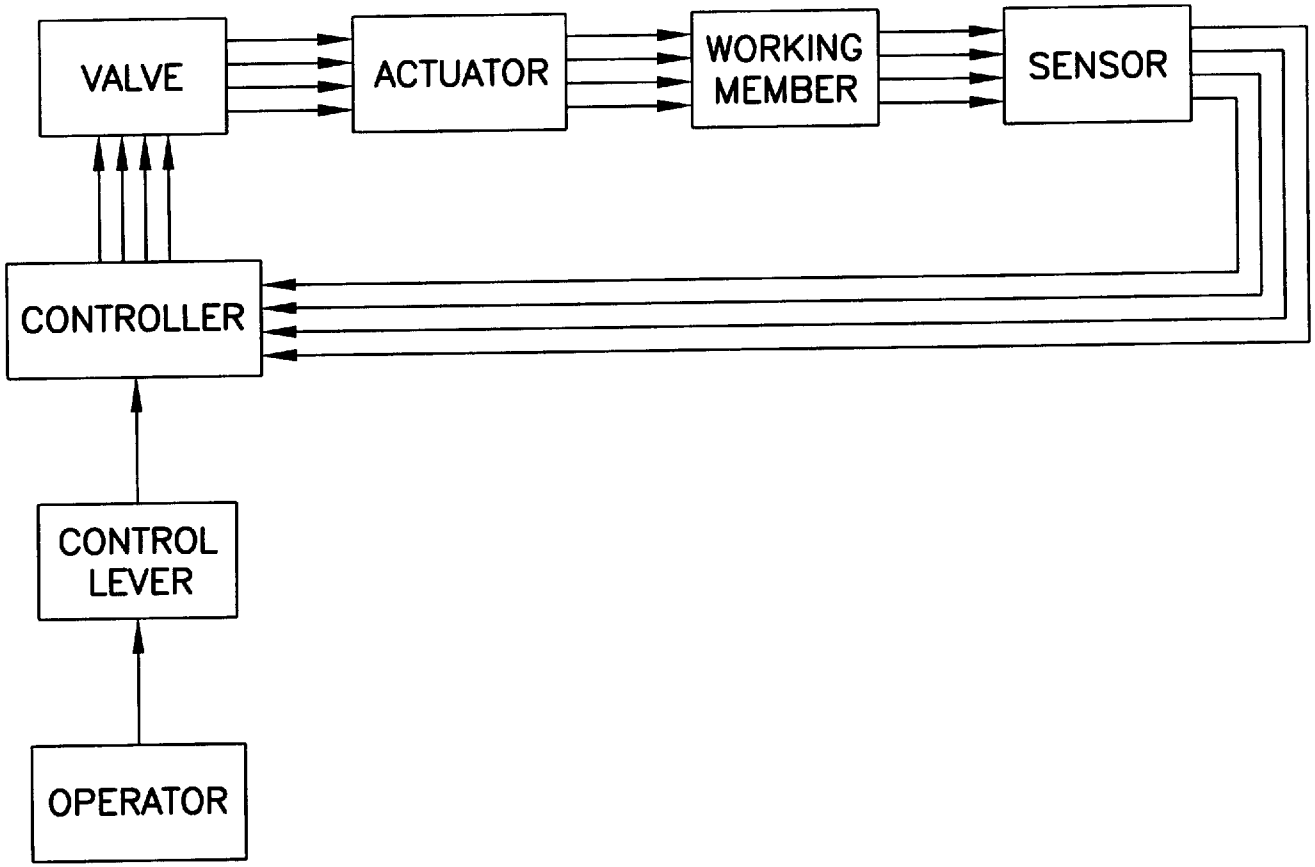
FIG. 2 PRIOR ART

The control process of this invention can be preferably used for controlling the operation of a power excavator having the same basic construction as that of the typical power excavator. That is, the power excavator of this invention includes an engine, a hydraulic pump driven by the output power of the engine, and a plurality of directional control valves used for delivering pressurized oil of the pump to actuators. The actuators are operated by the pressurized oil. The excavator further includes a plurality of working members operated by the actuators. The operation of the excavator is automatically performed under the control of a controller such as a microprocessor. The operator of the excavator inputs the target values of the working members by handling a plurality of electrical control levers.

The control process of the present invention is most preferably used for conducting an operation in which the same motions of the working members are repeated several times.

In the control process of this invention, the operator of the excavator handles the electrical control levers to start a desired operation. When the operator handles the levers, the levers outputs lever signals indicative of the target value of the working members to the controller. The controller stores the lever signals therein.

Thereafter, the working members are placed in their standby positions, respectively.

After placing the working members in their standby positions, an automatic control switch is turned on, thereby allowing the controller to reproduce the stored lever signals to move the working members. Therefore, the excavator automatically conducts the desired operation. While conducting the desired operation, the operator can selectively handle the electrical control levers to manually operate the working members, thereby modifying the operation and compensating for the operational errors. Otherwise stated, the manual operation of working members performed by the operator has a priority over the automatic operation performed by the controller. Of course, when the automatic operation performed by the controller has the desired operational precision, the operator will not need to handle the electrical control levers either to modify the operation or to compensate for operational errors.

When the power excavator is confronted with a difficult working condition, such as an obstacle which is scarcely overcome by the programmed operation, the operator turns off the automatic control switch and changes the automatic mode into a manual mode, thereby manually operating the excavator to overcome the difficult working condition. After manually overcoming the difficult working condition, the automatic control Is either switched back on, or the operation is stopped.

Meanwhile, it is preferred to store the motions of the working members in the immediately prior operation in the controller and to repeat the motions of the working members to approximately conduct the next operation instead of repeating the primarily stored motions of the working members every time the same operation is repeated. In the above case, the operator may handle the electrical control levers to manually move the working members, thereby compensating for the operational errors of the approximate operation. The above handling motions of the electrical control levers for compensating for the operational errors of the approximate operation are also stored in the controller and are reflected in the next approximate operation.

In addition, the controller may control part of the working members for approximately conducting a desired operation, while the operator may control other working members to compensate for operational errors of the approximate operation and to achieve the desired operational precision. For example, when the excavator conducts a land finishing operation, the controller reproduces the lever signals indicative of lever handling motions stored in the controller, thereby controlling the movement of both the boom and the arm to approximately conduct the land finishing operation. In the above case, the operator observes the movement of both the boom and the arm prior to compensating for the operational errors of the approximate operation performed by both the boom and the arm. Thereafter, the operator operates the bucket to compensate for the operational errors of the approximate operation and to accomplish the land finishing operation with the desired operational precision.

In accordance with the control process of the present invention, the controller only reproduces the stored signals to control the approximate operation, thereby needing no sensors for sensing the operational positions and angles of the working members. Therefore, the control process of this invention removes both the problem of increasing the cost caused by selecting and installing the sensors and the problem caused by the troubled sensors. In accordance with the control process of this invention, the controller only reproduces the stored signals and thereby controls the approximate operation by an open loop control. The control process thus remarkably simplifies the control algorithm. The control process of this invention allows the operator to either automatically or manually control the operation, thereby achieving the desired operational precision. The above control process also allows the operator to carefully check the working conditions of the excavator. The power excavator operated according to the control process of this invention can be more effectively used regardless of the working conditions.

The power excavator is operated according to the control process of this invention as follows, thereby conducting the land finishing operation which is one of the representative operations of the power excavators.

Figure 3:
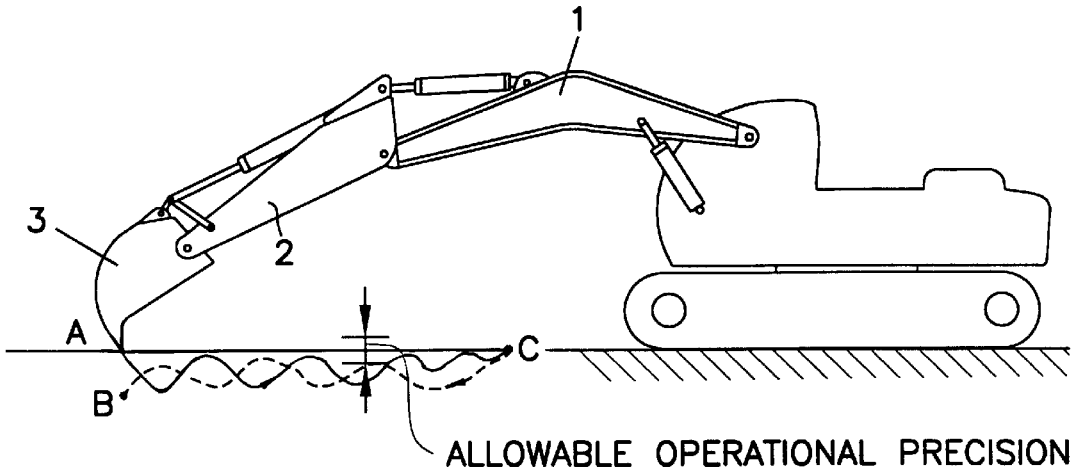
FIGS. 3 and 4 are side views of a power excavator operated in accordance with the control process of this invention, showing traces of the working members of the excavator which conduct a land finishing operation according to the control process.

The control process is started when the operator handles the electrical control levers. The control levers output the lever signals indicative of the lever handling motions to the controller which stores the lever signals. In the above case, the working members, that is, the boom 1, the arm 2 and the bucket 3, are moved as shown in FIG. 3. That is, the tip of the bucket 3 starts at position A and returns to position C by way of position B. Position C has a level similar to that of position A. While the working members approximately conduct the operation in the above operational range, precise operation is not required. However, the working members are allowed to approximately move such that the movement of the working members is similar to the movement suitable for conducting the desired operation. In other words, the bucket 3 is operated within the operational range suitable to compensate for the operational error of the approximate operation, while there is no problem even when the traces of the bucket's tip exceed the operational precision.

Thereafter, the automatic control switch is turned on to start the operation.

Figure 4:
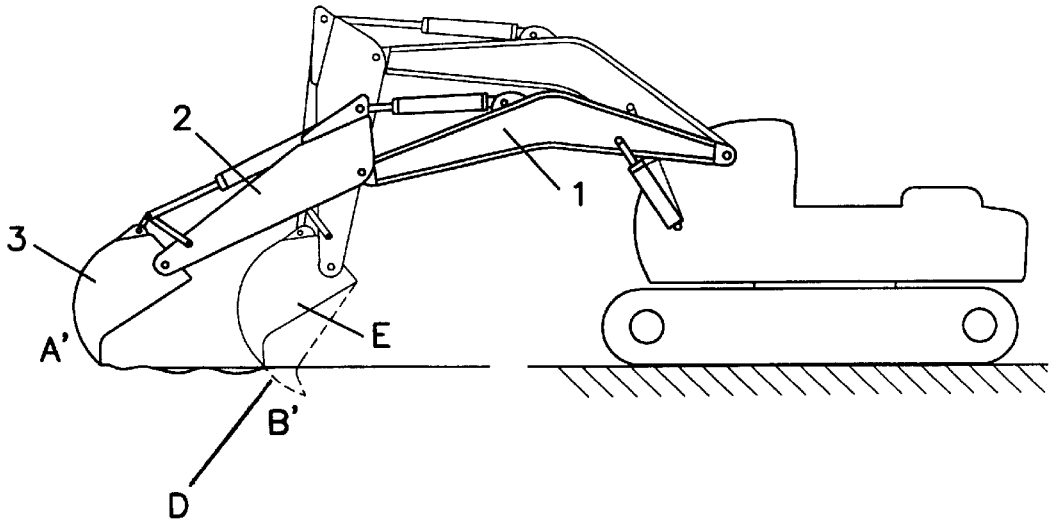

When turning on the automatic control switch, the controller reproduces the stored lever signals, thus controlling both the boom 1 and the arm 2 and approximately conducting the land finishing operation. While approximately conducting the land finishing operation, the operator observes the movement of both the boom 1 and the arm 2 prior to manually compensating for the operational errors. That is, while both the boom 1 and the arm 2 move from position A to position B, the operator controls the bucket 3 from position D to position E as shown in FIG. 4, thereby accomplishing the desired land finishing operation.

In the above land finishing operation according to the control process of this invention, both the boom and the arm have to move within an operational range in which the operational errors of both the boom and the arm can be compensated by the bucket. When either the boom or the arm exceeds the above operational range, the operator turns off the automatic control switch, and handles the electric control levers to manually control the boom and arm. Thereafter, the manual mode changes to the automatic mode.

As described above, the present invention provides a control process for automatically controlling the power excavators. The control process does not need any positional sensors, thereby saving money caused by selecting and installing the sensors and removing the problems caused by the troubled sensors. The control process also remarkably simplifies the control algorithm, thus allowing the control system for the excavators to be easily produced. Another advantage of the control process of this invention resides in that the excavator which is operated according to the above control process can be more effectively used regardless of the working conditions of the excavators.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A process for automatically controlling a power excavator having a plurality of serially articulated working members to conduct a desired operation, comprising the steps of:

storing lever signals for controlling the motions of part of the excavator's working members, said lever signals representing lever handling motions of an operator for operating said part of working members while conducting said desired operation;

reproducing stored lever signals and outputting control signals to said part of working members, thereby operating said part of working members automatically to approximately conduct said desired operation; and operating another working member other than said part of excavator's working members in accordance with a lever signal newly inputted by the operator without using means for detecting or calculating the motion of said another working member while said part of excavator's working members are operated automatically, wherein motion of said part of excavator's working members is independent of said operation of said another working member.

2. The process according to claim 1, wherein said desired operation is a land finishing operation, said part of excavator's working members are a boom and an arm, and said another working member is a bucket.

3. A method for automatically controlling a power excavator having a plurality of serially articulated working members, comprising the steps of:

storing control signals input by an operator for controlling at least one of said working members, said control signals being generated independent of any detection element for detecting motion of said working members;

automatically controlling operation of said at least one of said working members in accordance with said stored control signals; and manually controlling operation of another of said working members in accordance with manual control signals newly input by the operator while said at least one of said working members is being automatically controlled;

wherein said operation of said another of said working members being manually controlled is independent of said operation of said at least one of said working members.

* * * * *